US006247733B1

(12) United States Patent
Weiland

(10) Patent No.: US 6,247,733 B1
(45) Date of Patent: Jun. 19, 2001

(54) PUSH-PUSH LATCH WITH CLICKER

(75) Inventor: Nicholas Roy Weiland, Worcester (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/382,238

(22) Filed: Aug. 24, 1999

(51) Int. Cl.[7] ..... E05C 3/14

(52) U.S. Cl. ..... 292/228; 292/DIG. 4; 292/341.17

(58) Field of Search ..... 292/228, 341.17, 292/341.15, DIG. 4

(56) References Cited

U.S. PATENT DOCUMENTS

| | | | | |
|---|---|---|---|---|
| 2,548,046 | * | 4/1951 | Nottingham | 292/164 |
| 2,750,219 | * | 6/1956 | Bleam | 292/198 |
| 3,156,493 | * | 11/1964 | Griffiths | 292/341.17 |
| 3,830,554 | * | 8/1974 | Moussaian | 312/30 |
| 4,462,630 | * | 7/1984 | Omata | 296/37.9 |
| 4,655,489 | | 4/1987 | Bisbing . | |
| 4,660,881 | * | 4/1987 | Komeya | 296/37.9 |
| 4,712,845 | * | 12/1987 | Nicol | 312/319 |
| 5,050,922 | * | 9/1991 | Falcoff | 296/37.7 |
| 5,052,728 | * | 10/1991 | Fukumoto | 292/106 |
| 5,211,431 | * | 5/1993 | Koizumi | 292/81 |

OTHER PUBLICATIONS

Southco, Inc. catalog No. 48 NA.

* cited by examiner

*Primary Examiner*—Gary W. Estremsky
(74) *Attorney, Agent, or Firm*—Paul & Paul

(57) ABSTRACT

A push-push type latch and a pin are mounted on corresponding moving and nonmoving components, such as a drawer or door and its frame. The latch uses a shuttle having a heart-curve to control the latching and unlatching of the pin. The shuttle is mounted on the housing using an off center pivot. As the pin moves back and forth within the shuttle, the shuttle pivots to control the pin's location within the heart curve. The latch may include a spring-biased fork for making an audible click to denote the latching and unlatching of the latch.

26 Claims, 17 Drawing Sheets

14
18
20
12
10

PUSH-PUSH LATCH WITH CLICKER

BACKGROUND OF THE INVENTION

1. Field of the Invention

The present invention is a push-push type latch for receiving a corresponding pin within a heart-shaped shuttle, and having a fork-shaped clicker for audibly indicating proper engagement and disengagement of the latch.

2. Description of the Related Art

Although other inventors have proposed latches for which latching and unlatching are actuated by an inward push by the member mating with the latch, the present inventor is unaware of any latch having a heart-curve having a pivot offset to one side of the pin mating with the latch. Additionally, the present inventor is unaware of any present latch using a fork-shaped clicker.

An example of a push-push latch is U.S. Pat. No. 4,655,489, issued to Robert H. Bisbing on Apr. 7, 1987, describes a push-push latch wherein an inward push on the shuttle causes the hook on a beam to engage or disengage a corresponding hook on a keeper. The latch is also described in Southco, Inc. catalog no. 48 NA. This latch does not include a heart-curve within the shuttle to retain the keeper, and does not use a clicker.

Other push-push type latches have used heart-curves, but the present inventor is unaware of any heart-curves having a pivot offset to one side of the keeper's pin, as in the present invention.

SUMMARY OF THE INVENTION

The invention is a latch having a shuttle with a heart-curve for retaining a pin, and an optional fork for making a clicking noise upon actuation of the latch. Such a latch has a wide variety of uses in securing a moving component, such as a door or drawer, to a nonmoving component, such as the frame supporting a door or drawer. A moving member used with a latch of the present invention will typically be spring-biased towards its fully open position, so that the moving member will move in that direction unless constrained by the latch or by the user pushing the moving member towards the closed position.

The latch uses a generally rectangular housing having frontal and top openings for receiving the corresponding pin, and at least one pair of opposing holes for receiving pivots on the shuttle and the clicker. The housing will generally be mounted on the nonmoving component, but may be mounted on the moving component if desired. A pin being dimensioned and configured to mate with the latch will be mounted to the opposing component.

The main operative component within the latch is the shuttle. The shuttle is pivotally secured within the housing, with the pivot offset to one side of the shuttle and the housing. Preferably, a pair of pegs fits within the pair of opposing holes on the housing. The pivot point corresponds to the front of the shuttle. The opposite side of the shuttle's front includes the entrance to the heart-curve. This entrance defines the beginning of a channel extending rearward into the shuttle. At the rearmost portion of the shuttle, the channel widens, defining a first and a third socket. An island occupies the center of the channel, defining a ramp and a second socket. The resulting channel, including the island, ramp, and sockets, defines the heart-curve, which, as will be explained in greater detail below, mates with a corresponding pin to secure and unsecure the latch.

The latch may optionally include a clicker for audibly signaling the latching and unlatching of the latch. The clicker is in the form of a three-pronged fork pivotally secured to the front of the housing, opposite the shuttle. The fork is spring-biased so that the prongs point towards the shuttle, approximately parallel to the front of the housing. The prongs are arranged from shortest to longest, going towards the rear of the housing.

In use, the pin will enter the shuttle's heart-curve as the two components of the door or drawer are closed. The pin will pass through the entrance channel, and strike the ramp, thereby pivoting the shuttle. The pin will simultaneously begin pushing rearward on the first, shortest prong of the fork. As the pin continues to travel rearward in the shuttle, it will come to rest at the first socket, thereby further pivoting the shuttle so that the island and second socket are directly in front of the first socket. As the pin reaches the first socket, it will also reach the end of the short prong, allowing the spring to push the fork back towards its original position. The middle prong will strike the pin, causing a clicking noise to audibly indicate that the door or drawer is fully closed. Once the door or drawer is released and no longer pushed inward by the user, the spring-biased door or drawer will move slightly outward, moving the pin forward in the heart curve to the second socket, corresponding to the latched position.

The door or drawer is opened by an inward push. As the pin moves towards the rear of the heart-curve, it moves from the second socket to the third socket, simultaneously rotating the shuttle. As the pin reaches the third socket, it will also reach the end of the middle prong, again allowing the spring to push the fork toward its original position. The longest prong will strike the pin, causing a clicking noise. When the door or drawer is released, the pin now has a clear path forward through the heart curve to the entrance/exit, allowing the pin to leave the latch.

It is therefore an object of the present invention to provide a push-push type latch using a shuttle having a heart-curve and a pivot offset to one side.

It is another object of the present invention to provide a push-push type latch which is especially useful for doors and drawers which are spring-biased towards their open position.

A third object of the present invention is to provide a push-push type latch having an optional clicker for audibly indicating the latching and unlatching of the latch.

A fourth object of the present invention is to provide a clicker utilizing a three-pronged fork for making a clicking sound upon both latching and unlatching.

These and other objects of the invention will become apparent through the following description and claims.

BRIEF DESCRIPTION OF THE DRAWINGS

Like reference numbers denote like elements throughout the drawings.

DETAILED DESCRIPTION OF THE PREFERRED EMBODIMENTS

Figure 1:
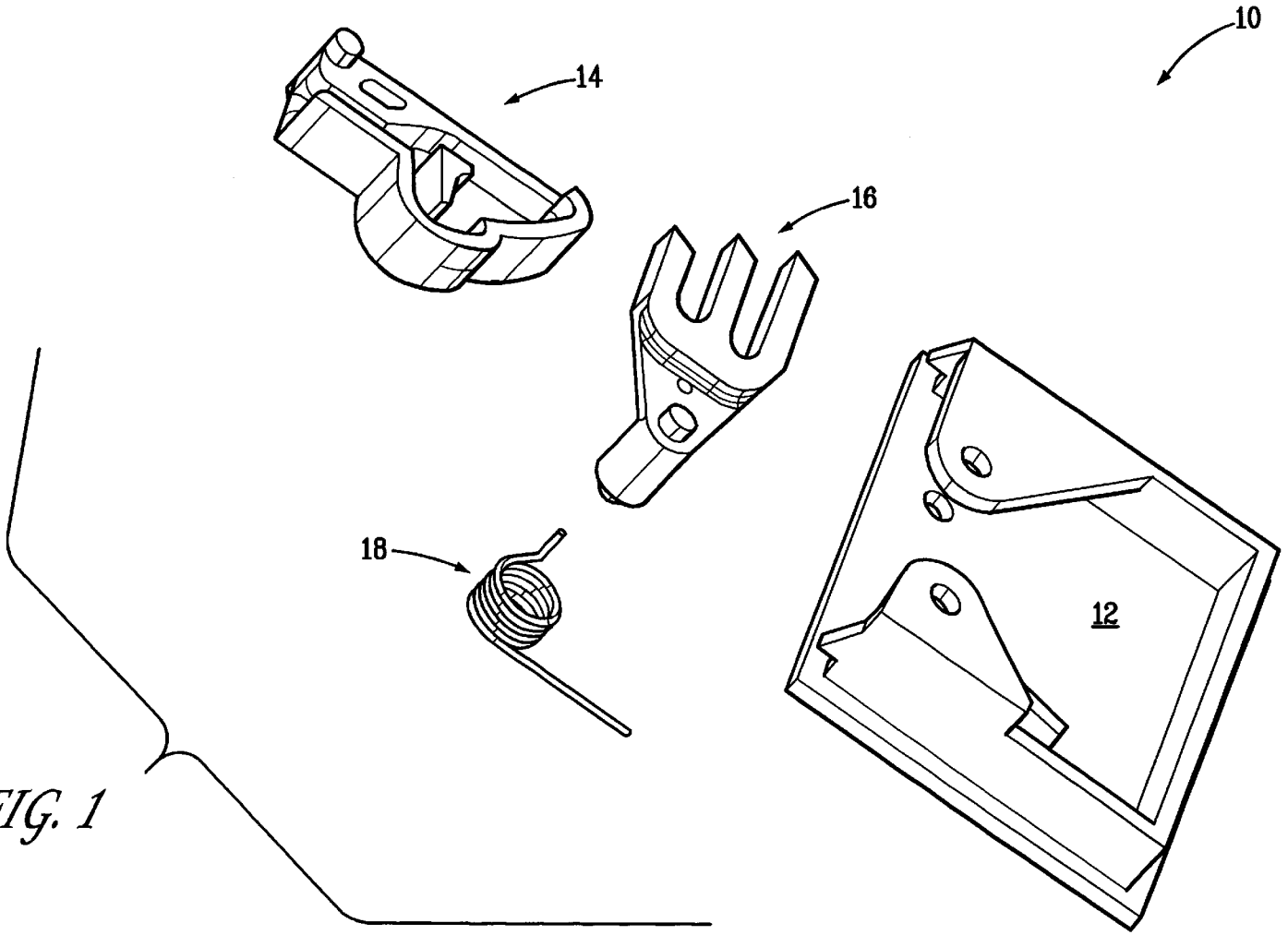
FIG. 1 is a top and front exploded perspective view of a push-push latch according to the present invention.
Figure 2:
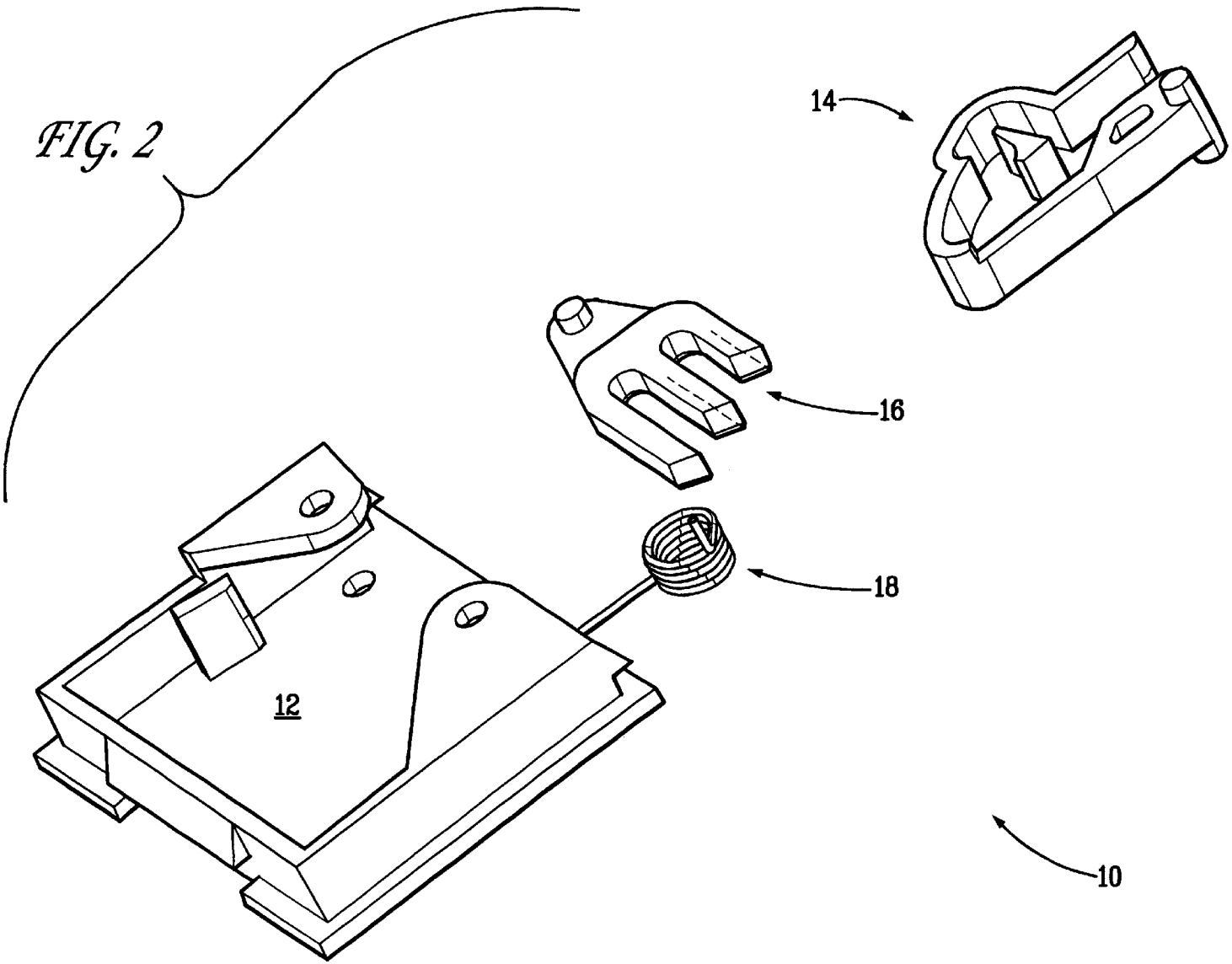
FIG. 2 is a top and rear exploded perspective view of a push-push latch according to the present invention.
Figure 3:
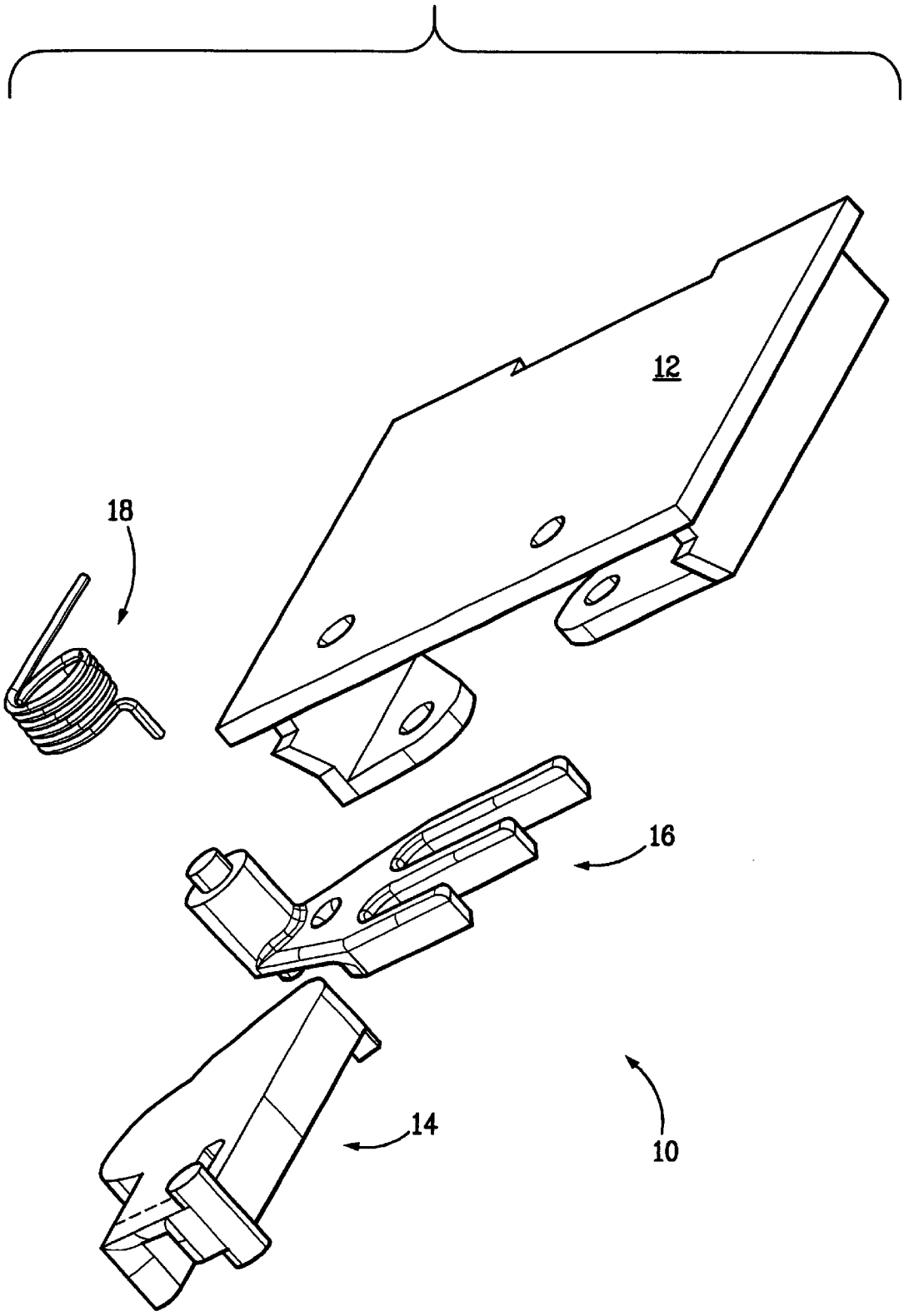
FIG. 3 is a bottom and front exploded perspective view of a push-push latch according to the present invention.
Figure 4:
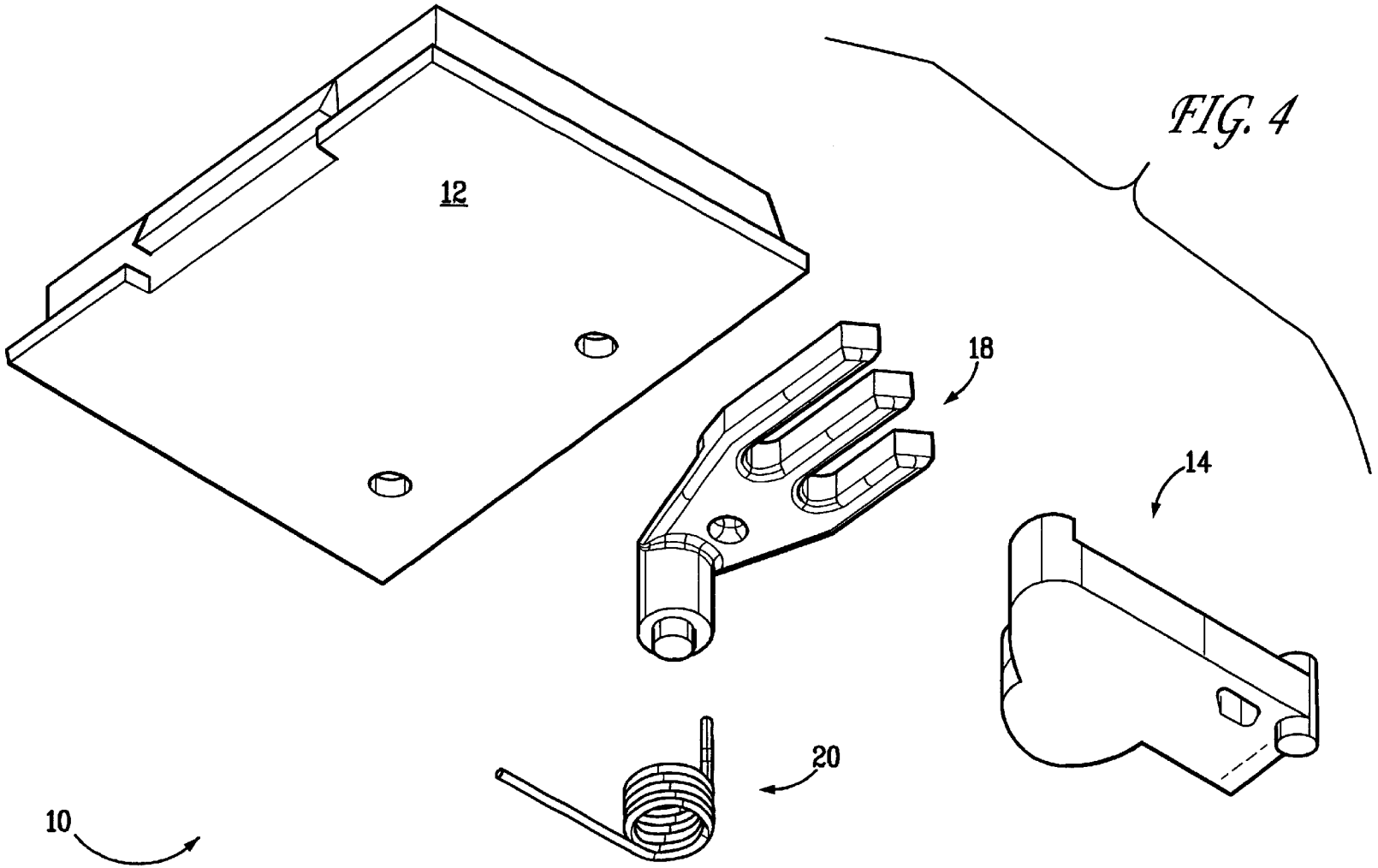
FIG. 4 is a bottom and rear exploded perspective view of a push-push latch according to the present invention.
Figure 7:
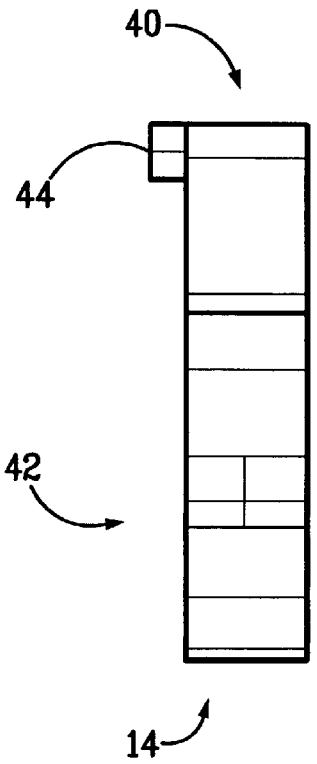
FIG. 7 is a top view of a shuttle for a latch according to the present invention.
Figure 6:
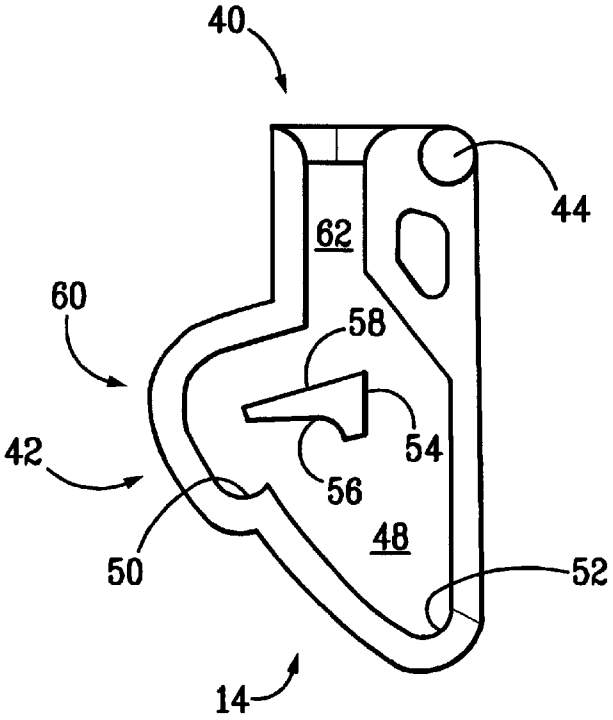
FIG. 6 is a top view of a shuttle for a latch according to the present invention.
Figure 5:
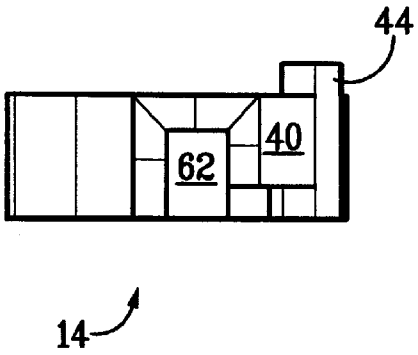
FIG. 5 is a front view of a shuttle for a latch according to the present invention.
Figure 8:
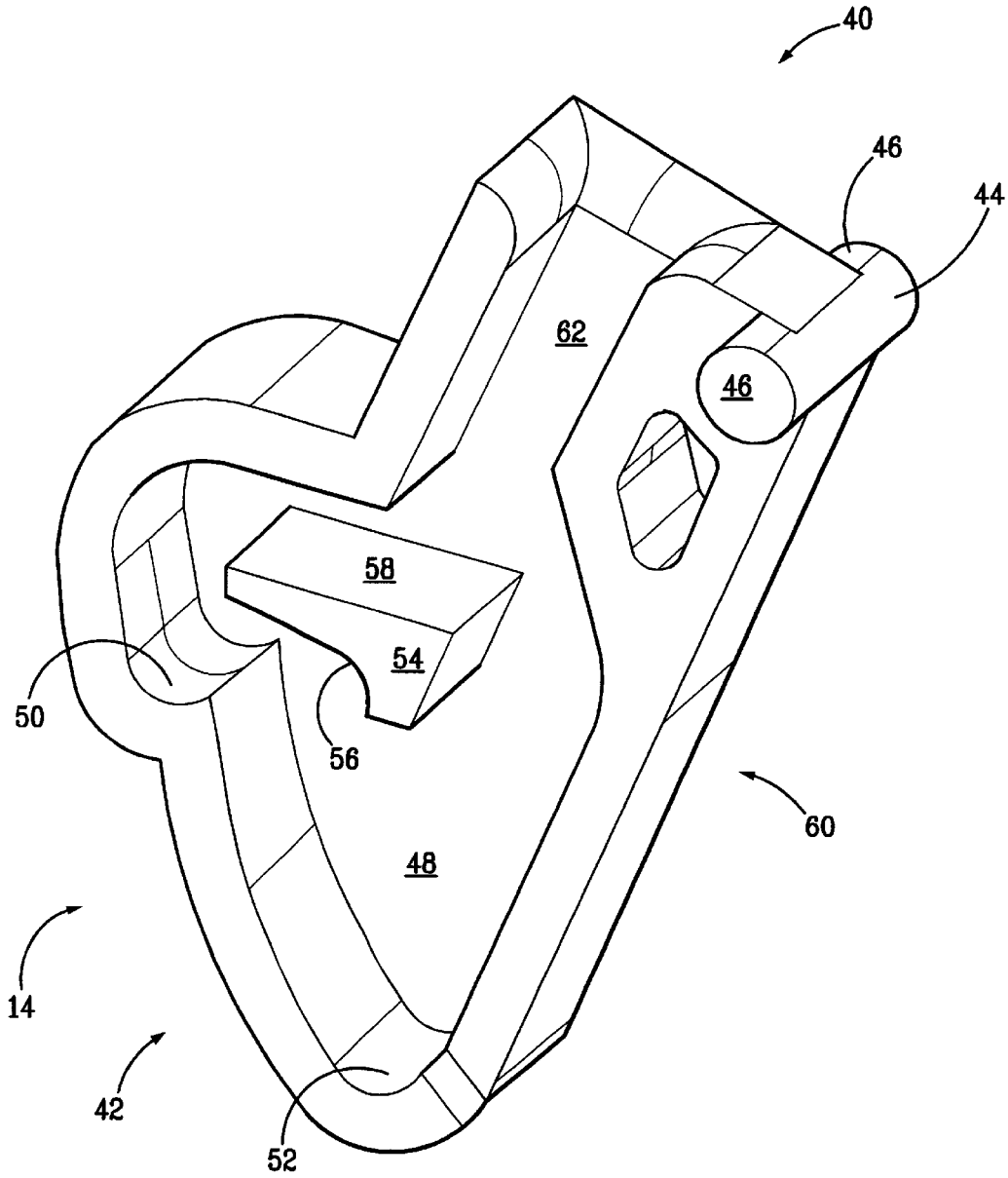
FIG. 8 is a perspective view of a shuttle for a latch according to the present invention.
Figure 9:
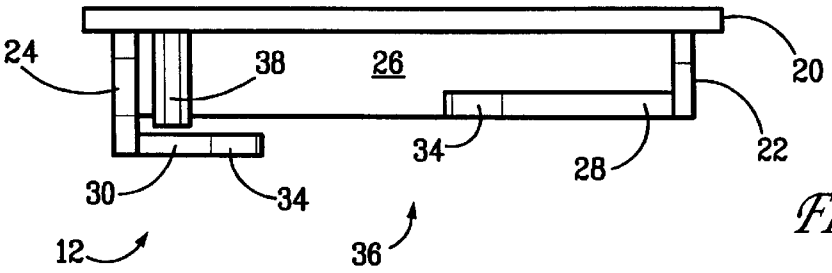
FIG. 9 is a front view of a housing for a latch according to the present invention.
Figure 10:
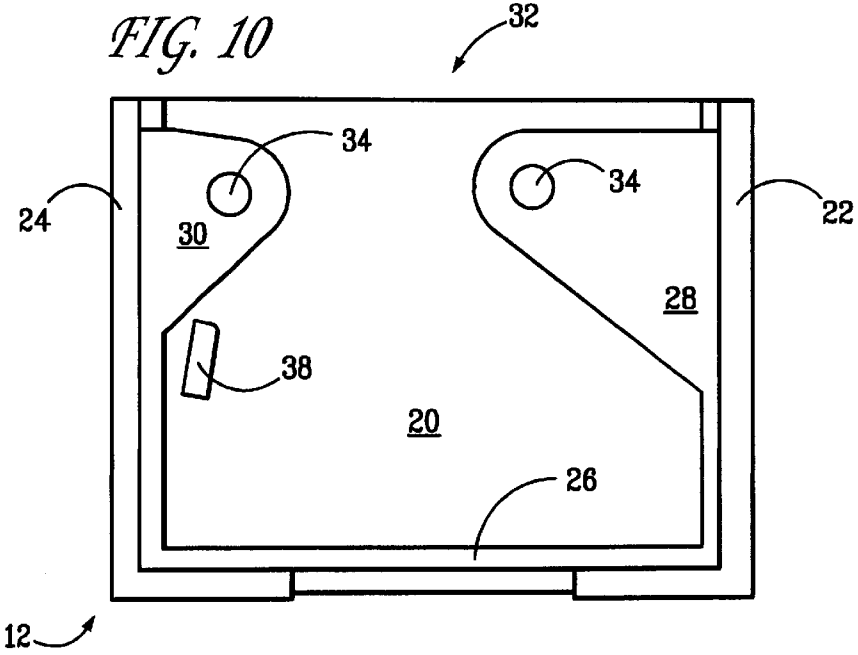
FIG. 10 is a top view of a housing for a latch according to the present invention.
Figure 11:
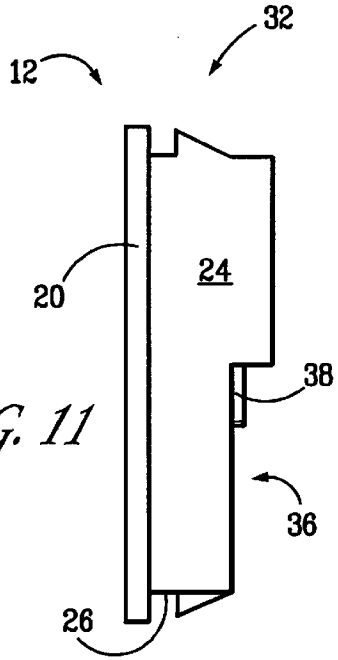
FIG. 11 is a side view of a housing for a latch according to the present invention.
Figure 12:
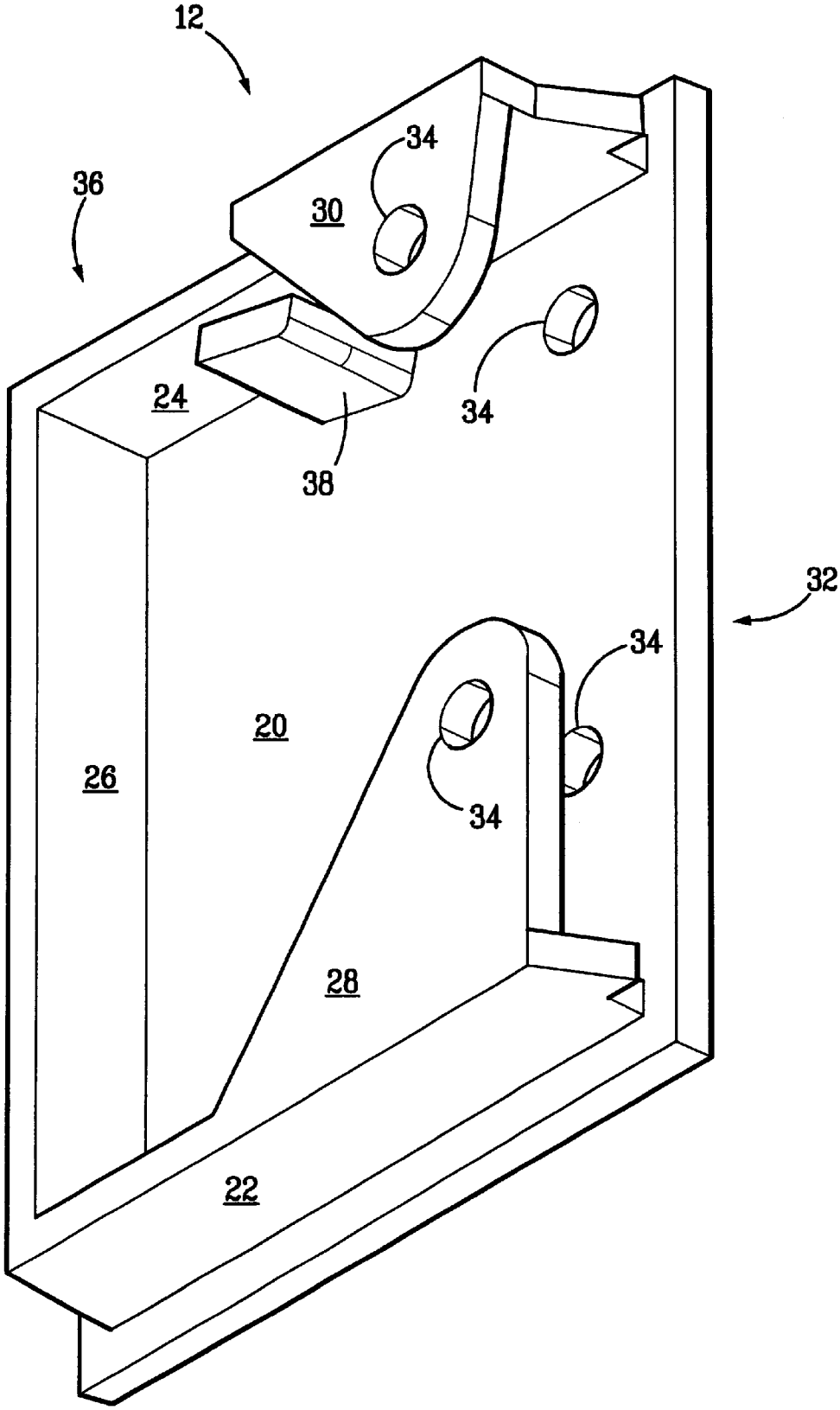
FIG. 12 is a perspective view of a housing for a latch according to the present invention.
Figure 15:
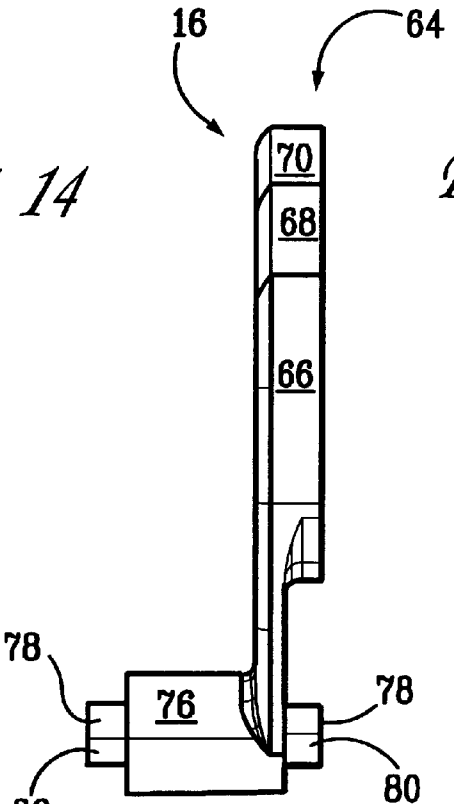
FIG. 15 is a side view of a fork for a latch according to the present invention.
Figure 14:
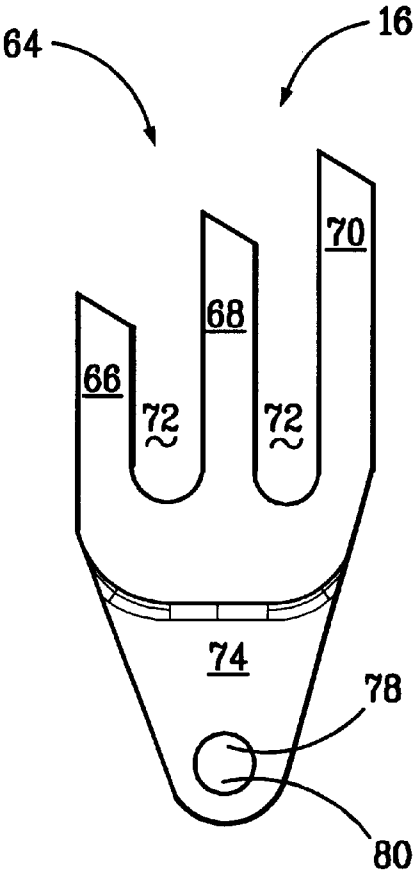
FIG. 14 is a top view of a fork for a latch according to the present invention.
Figure 13:
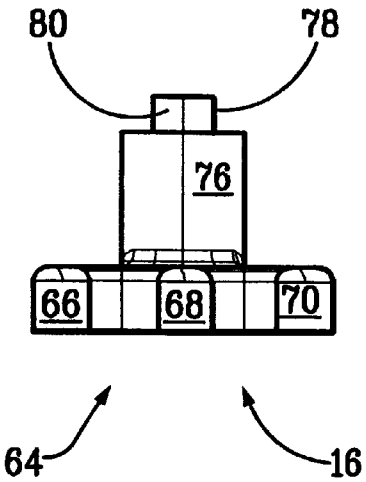
FIG. 13 is a front view of a fork for a latch according to the present invention.
Figure 16:
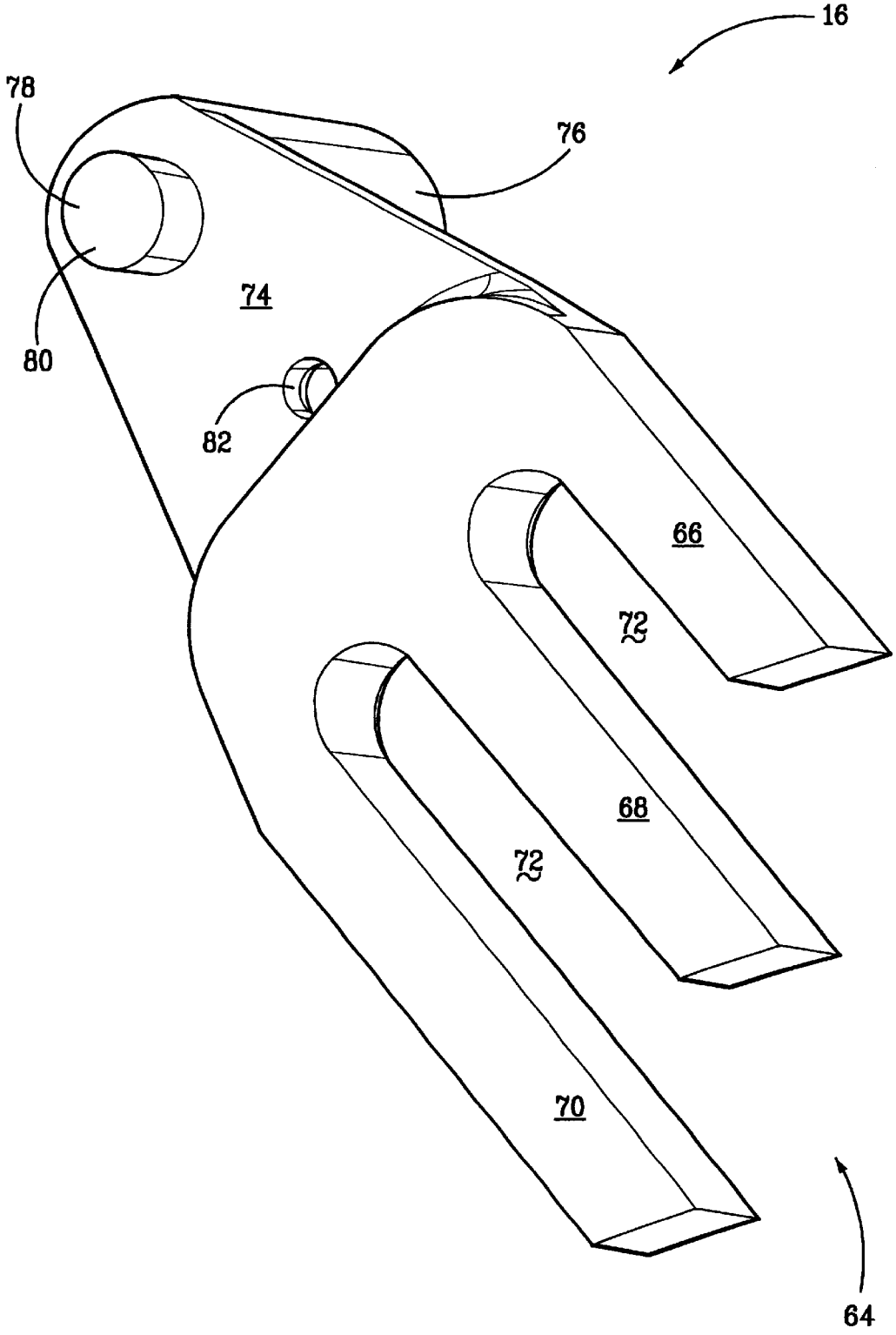
FIG. 16 is a perspective view of a fork for a latch according to the present invention.
Figure 17:
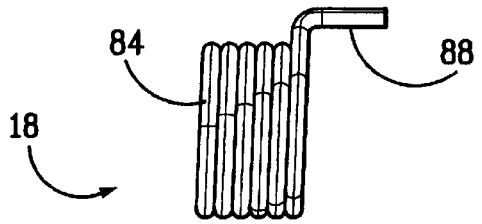
FIG. 17 is a front view of a spring for a latch according to the present invention.
Figure 18:
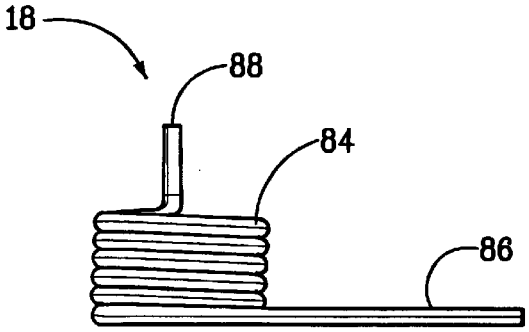
FIG. 18 is a side view of a spring for a latch according to the present invention.
Figure 19:
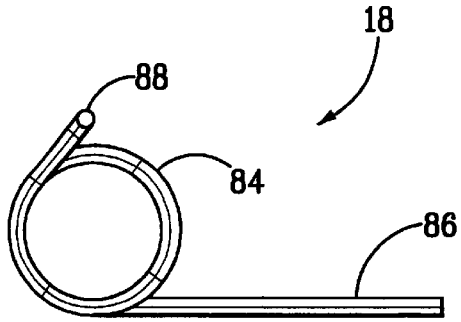
FIG. 19 is a top view of a spring for a latch according to the present invention.
Figure 20:
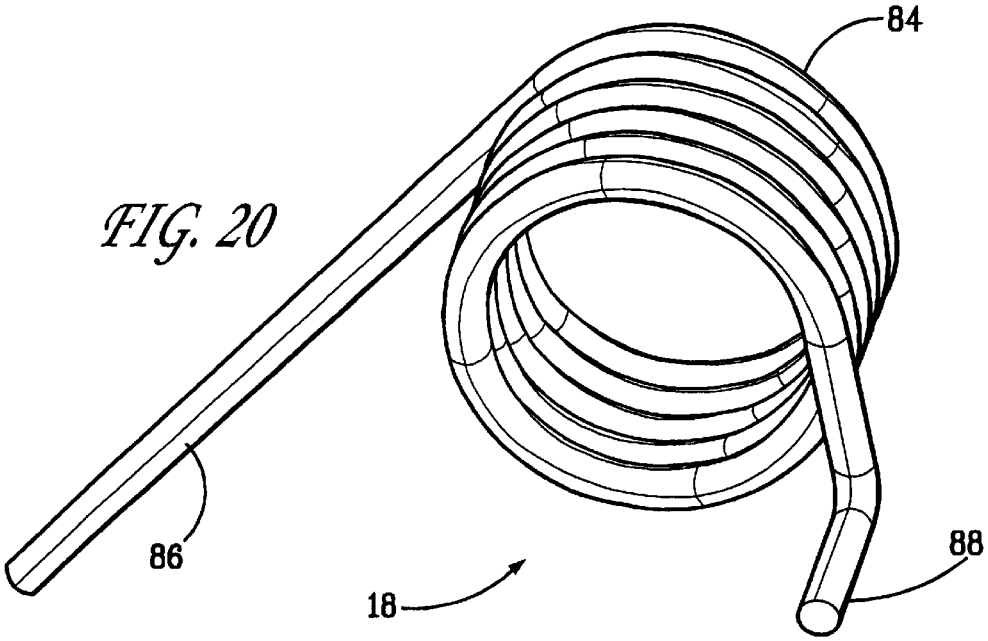
FIG. 20 is a perspective view of a spring for a latch according to the present invention.

The invention is a push-push latch using a heart-curve having an off center pivot to control the latching and unlatching of a corresponding pin. For purposes of simplicity of reference, a portion of the latch was arbitrarily called the top, and the use of such terms is not to be construed to imply that the orientation of the latch is critical to its functioning. Referring to FIGS. 1–4, the latch 10 includes a housing 12, containing a shuttle 14, a fork 16, and a spring 18 for biasing the fork as described in detail below.

Referring to FIGS. 9–12, the housing 12 is illustrated. The housing 12 is generally rectangular in shape, having a bottom 20, a pair of sides 22,24, and a back 26. A pair of flanges 28,30 extend from the sides 22,24 over the top of the housing 12, near the open front portion 32, leaving the top portion 36 substantially open. Preferably, the flange 30 is slightly farther from the bottom 20 than the flange 28. The housing includes means for pivotally mounting at least one component. Preferably, each flange defines a hole 34, and the bottom 20 includes a pair of opposing holes. The housing also preferably includes a spring-retaining flange 38, adjacent to side 24 and flange 30.

Referring to FIGS. 5–8, the shuttle 14 is illustrated. Shuttle 14 includes a front portion 40 and a rear portion 42. The front portion 40 includes a pivot 44 for mating with the housing, which in the preferred embodiment will be a pair of cylindrical pegs 46, dimensioned and configured to fit within the holes 34. It should be noted that reversing the pegs 46 and holes 34 would work equally well. The front portion 40 also defines an entrance channel 62 for allowing a corresponding pin to enter the shuttle 14. The rear portion 42 defines a second channel 48 that has greater dimensions than the entrance channel 62. The second channel 48 includes a first socket 50 and a third socket 52, both facing forward. An island 54 occupies the center of the second channel 48, defining a rearward facing second socket 56, and a forward facing ramp 58. The ramp 58 is dimensioned and configured to deflect a pin (described later) towards the first socket 50. The channels 62,48, sockets 50,52,56, and ramp 58 define the heart-curve 60.

Referring to FIGS. 13–16, the fork 16 is illustrated. The fork 16 includes a plurality of prongs 64, with three prongs being a preferred and suggested number. The prongs are arranged in order of increasing length, so that the shortest prong 66 on one side, an intermediate length prong 68 on the other side, and the longest prong 70 on the opposite side. A channel 72 is defined between each two adjacent prongs 64, with the channel 72 being dimensioned and configured to contain the pin (described later). The three prongs 64 join together at their rear juncture 74. A stem 76 projects downward from the rear juncture, perpendicular to the prongs 64. The stem includes a pivot 78, preferably a pair of opposing pegs 80, being dimensioned and configured to fit within the holes 34 of the housing. It should be noted that reversing the pegs 80 and holes 34 would work equally well. A hole 82 is defined within the rear juncture 74.

Referring to FIGS. 17–20, spring 18 is illustrated. Spring 18 is preferably a wire coiled spring having a central coil 84, a long end 86 projecting outward perpendicular to the axis of the coil, and a short end 88 projecting outward parallel to the axis of the coil. The long end 86 is dimensioned and configured to fit between spring-retaining flange 38 and side 24 of housing 12. The short end 88 is dimensioned and configured to fit within the hole 82 of the fork 16.

Referring to FIGS. 1–4 and 21–31, the assembly of components forming the latch is illustrated. Pegs 46 of shuttle 14 fit within the holes 34 of housing 12 corresponding to the flange 28 and bottom 20, so that the front portion 40 of shuttle 14 corresponds to the front 32 of housing 12.

Shuttle 14 thereby pivots freely with respect to housing 12. The coil 84 of spring 18 fits around the stem 76 of fork 16. Pegs 80 of fork 16 fit within the holes 34 of housing 12 corresponding to the flange 30 and bottom 20, so that the short prong 66 corresponds to the front portion 32 of housing 12, and so that all prongs 64 fit over top of and adjacent to shuttle 14. The long end 86 of spring 18 fits between spring-retaining flange 38 and side 24 of housing 12. The short end 88 fits within the hole 82 of the fork 16. The spring 18 thereby biases the fork 16 towards a position wherein the prongs 64 are approximately parallel to the front 32 of housing 12. It should be noted that if a clicker is not desired, then the fork 16 and spring 18 may be omitted without compromising the essential function of the latch.

The operation of the latch is illustrated sequentially in FIGS. 21–31, from which the spring 18 has been omitted for simplicity. The latch is designed to operate in conjunction with a pin 90 to secure a moving member such as a door or drawer to a nonmoving member such as the frame supporting the door or drawer. Either the latch 10 or the pin 90 may be secured to either the moving or nonmoving member, as long as the opposing member includes the mating component. The moving member for which a latch of the present invention will be used will typically be spring-biased outward towards its fully open position (not shown, and well-known). Therefore, unless the moving member is constrained by either the latch or by a user pushing the moving member towards its closed position, it will always move towards its fully open position. The pin 90 will typically project downward, parallel to the axis defined by the pivot 44 of the shuttle 14, so that, as the pin 90 enters the latch through the front, the member to which the pin 90 is attached will be adjacent to and overtop of the latch 10, with the pin projecting downward into the latch from the top 36. The pin 90 is of course dimensioned and configured to move within the channels 62,48.

Figure 21:
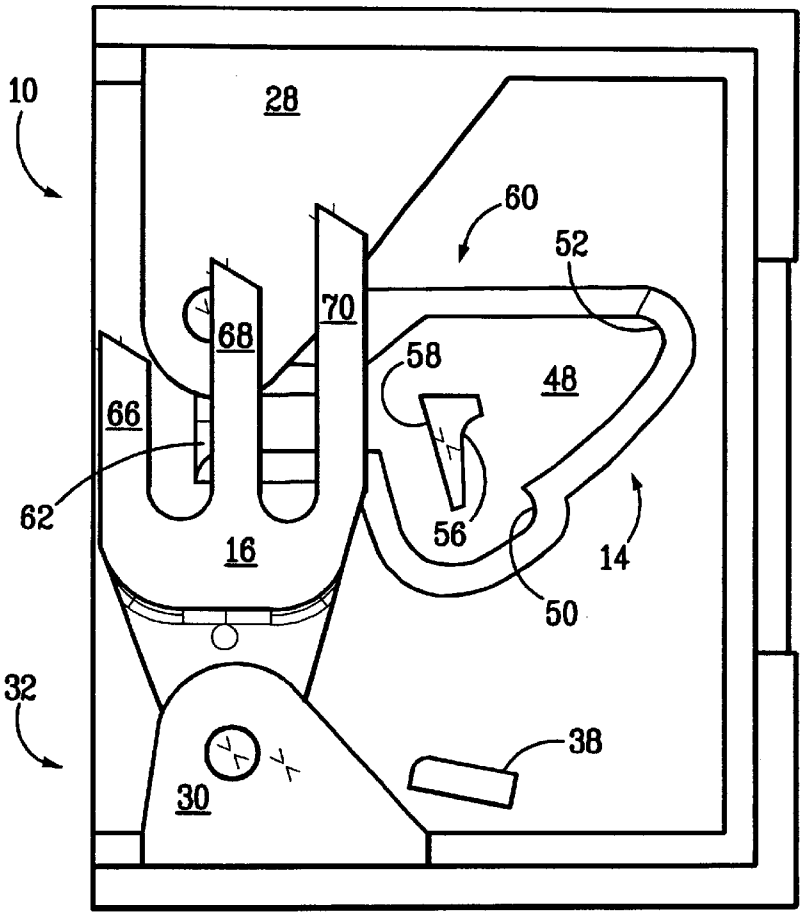
FIG. 21 is a top view of a latch according to the present invention, showing the components in their unlatched, at rest positions.

FIG. 21 illustrates the initial configuration of the latch 10. The shuttle 14 is initially oriented with channel 62 directly facing and perpendicular to the latch's front 32. The fork 16 is oriented so that the prongs 66,68,70 are parallel to the front 32 of the latch 10, and all three prongs 66,68,70 are in the path of a pin entering the shuttle's entrance channel 62. In this configuration, the latch 10 is ready to receive the pin 90.

Figure 22:
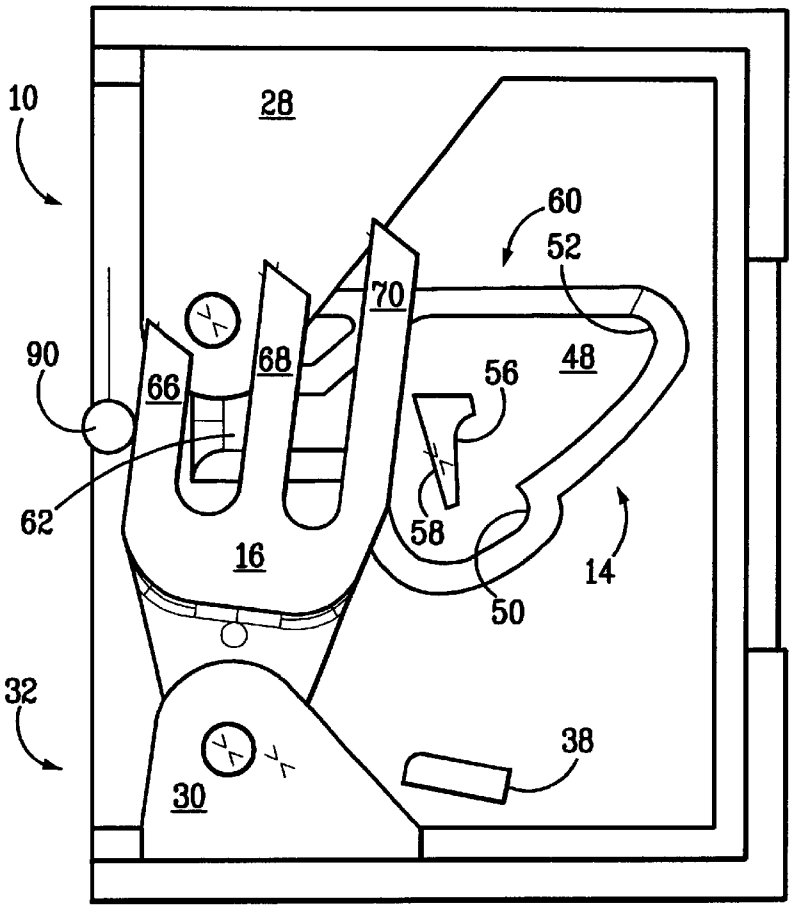
FIG. 22 is a top view of a latch according to the present invention, showing the position of the components as the pin first enters the shuttle.

FIG. 22 illustrates the orientation of the latch's components when the pin 90 initially makes contact with the prong 66 of fork 16 before entering channel 62 of shuttle 14, which will occur when a user pushes the moving member towards the nonmoving member. As the pin 90 continues to move rearward into the latch 10, the fork 16 will rotate clockwise, allowing the pin 90 to continue moving into the shuttle 14, until the pin 90 makes contact with the ramp 58, illustrated in FIG. 23.

Figure 24:
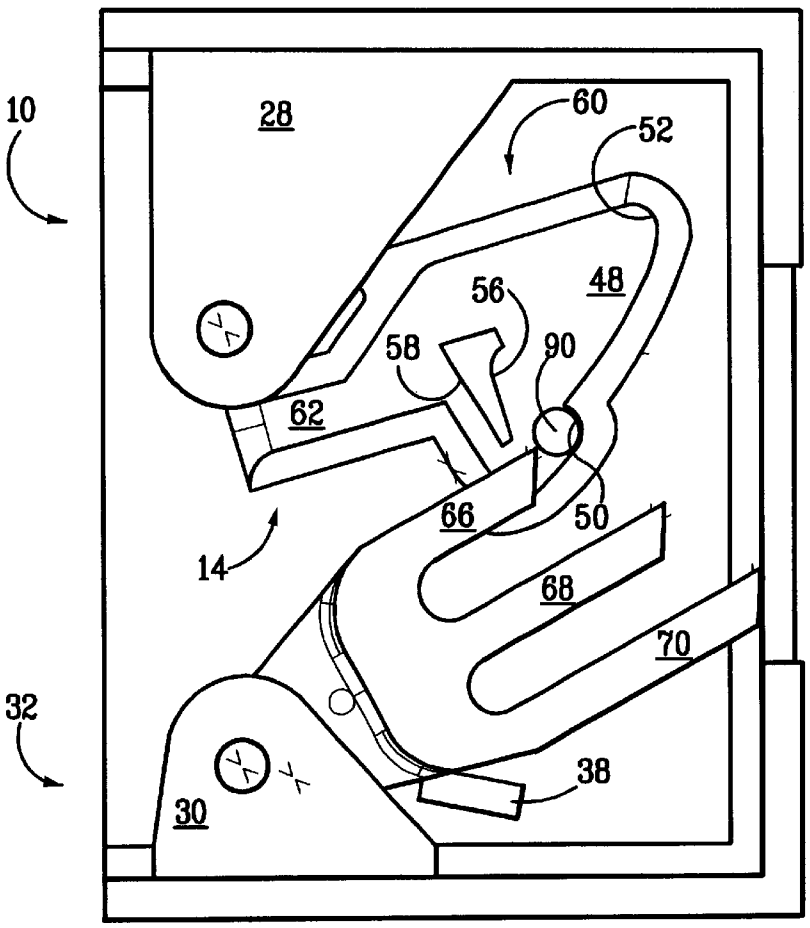
FIG. 24 is a top view of a latch according to the present invention, showing the position of the components as the pin enters the first socket.
Figure 23:
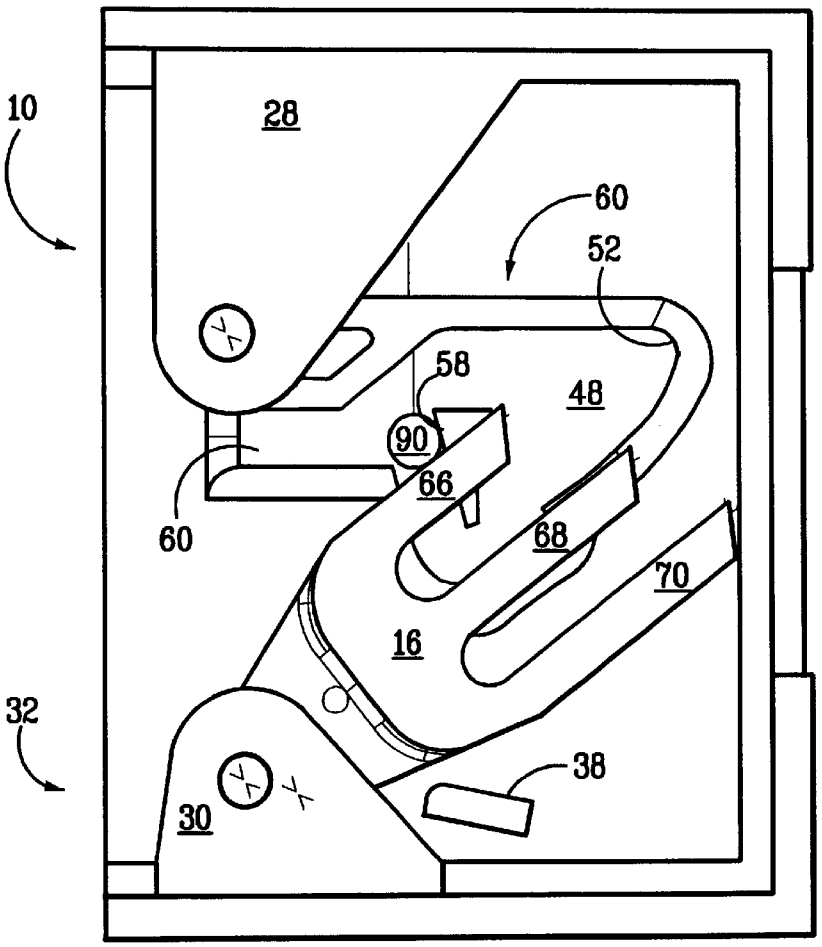
FIG. 23 is a top view of a latch according to the present invention, showing the position of the components as the pin strikes the ramp.
Figure 26:
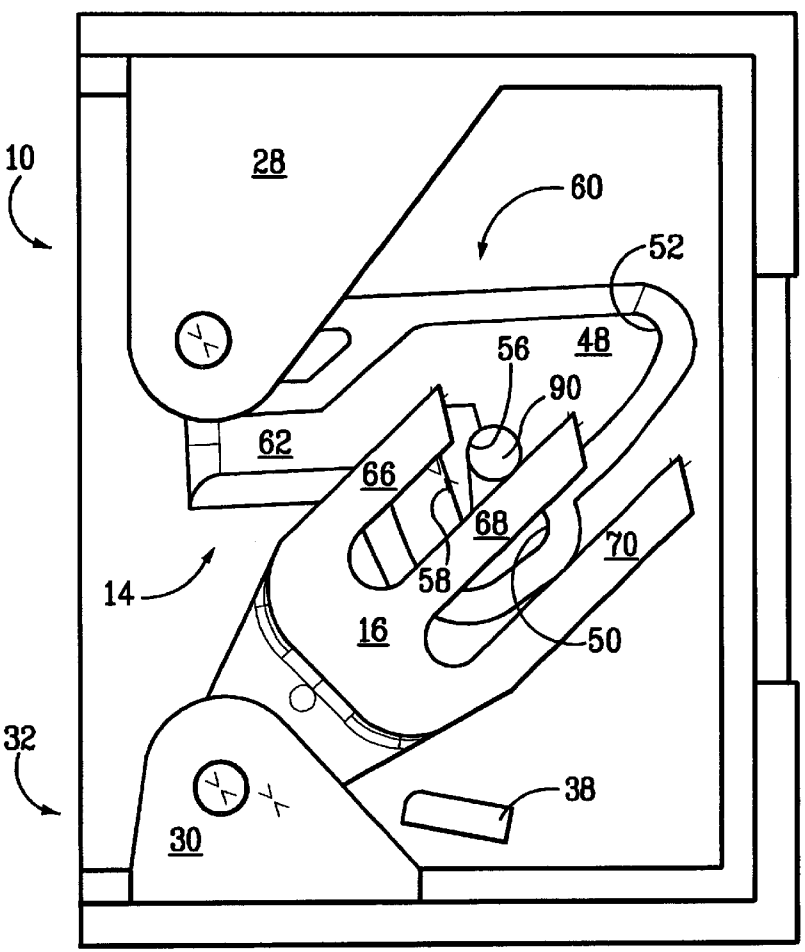
FIG. 26 is a top view of a latch according to the present invention, showing the position of the components as the pin enters the second socket.
Figure 25:
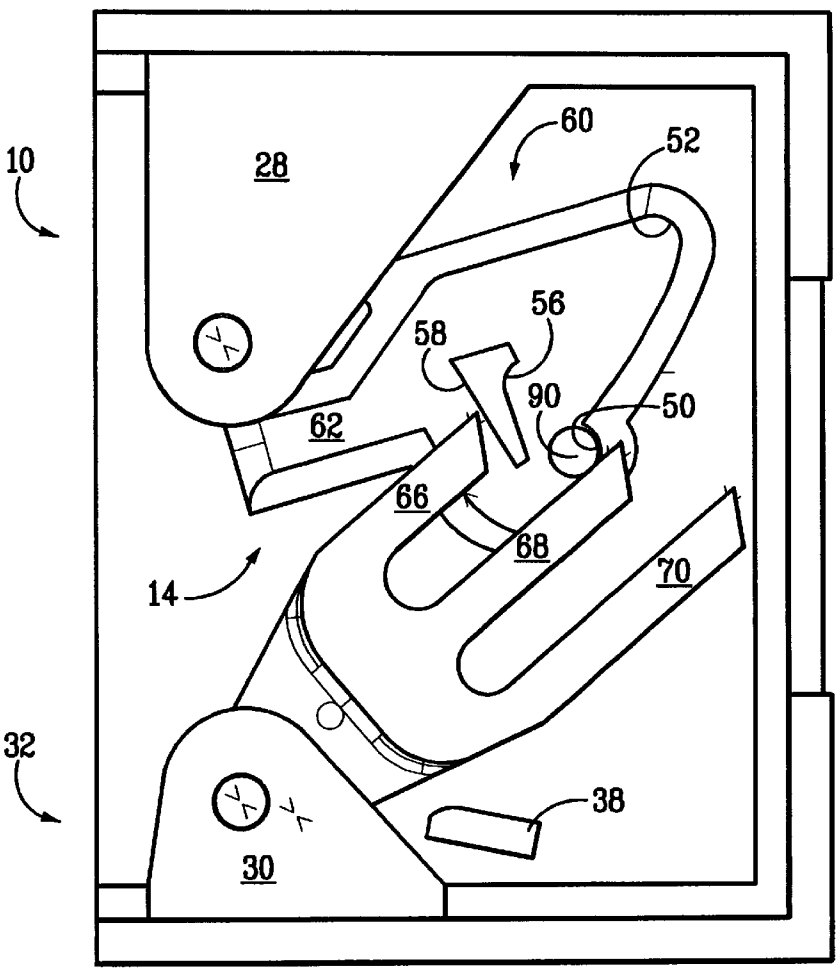
FIG. 25 is a top view of a latch according to the present invention, showing the position of the components as the fork's middle prong strikes the pin.

Upon the pin 90 making contact with the ramp 58, the shuttle 14 will rotate counterclockwise, so that as the pin 90 continues to move rearward in a linear manner, it will reach first socket 50, illustrated in FIG. 24. Upon reaching first socket 50, any further rearward movement of the pin 90 is prevented. Additionally, the pin 90 will simultaneously reach the end of the prong 66. Because the pin 90 is no longer pushing rearward on prong 66, the spring 18 will rotate the fork 16 counterclockwise towards its original position, until the prong 68 strikes the pin, making an audible click, as illustrated in FIG. 25. Upon hearing the click and feeling that the moving member can no longer move further rearward, the user will discontinue pushing the moving member rearward, at which point the moving member will move slightly forward under spring pressure. The pin 90 will therefore move forward in a linear manner until reaching the second socket 56, where it will continue to move forward until it has pushed the shuttle 14 back into its original position, as illustrated in FIG. 26. At this point, the latch 10 is securely latched closed, with the second socket 56 preventing the pin 90 from exiting, and the spring-biased moving member securing the pin 90 within the second socket.

Figure 28:
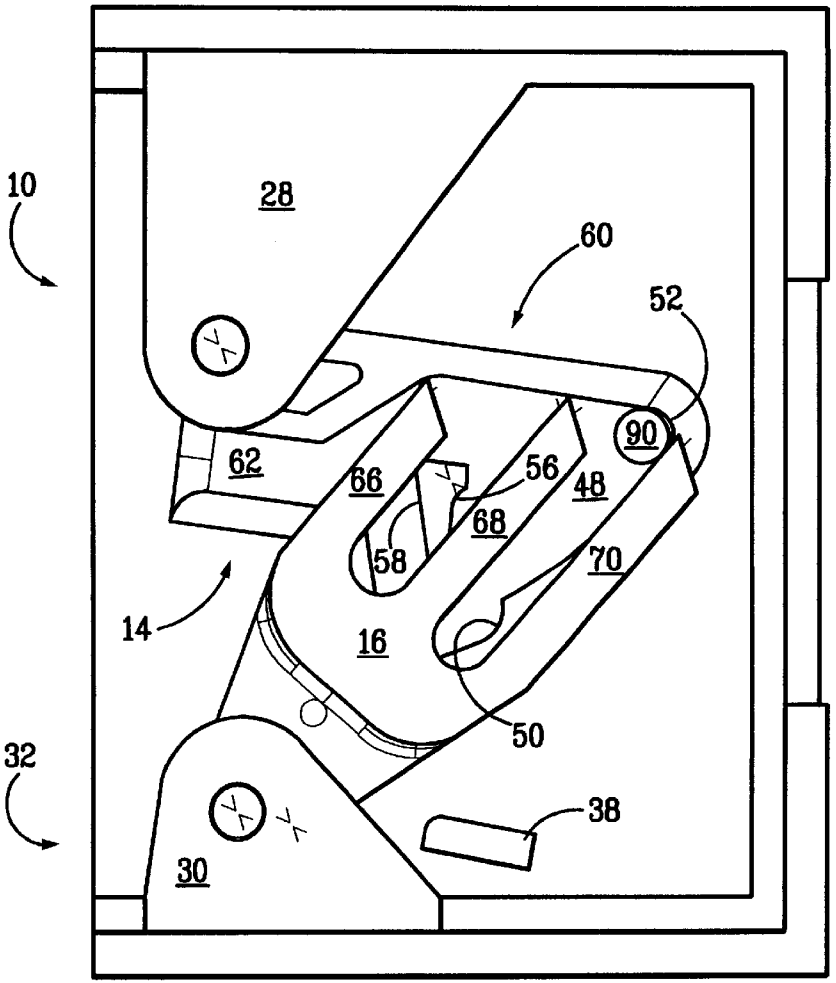
FIG. 28 is a top view of a latch according to the present invention, showing the position of the components as the fork's last prong strikes the pin.
Figure 27:
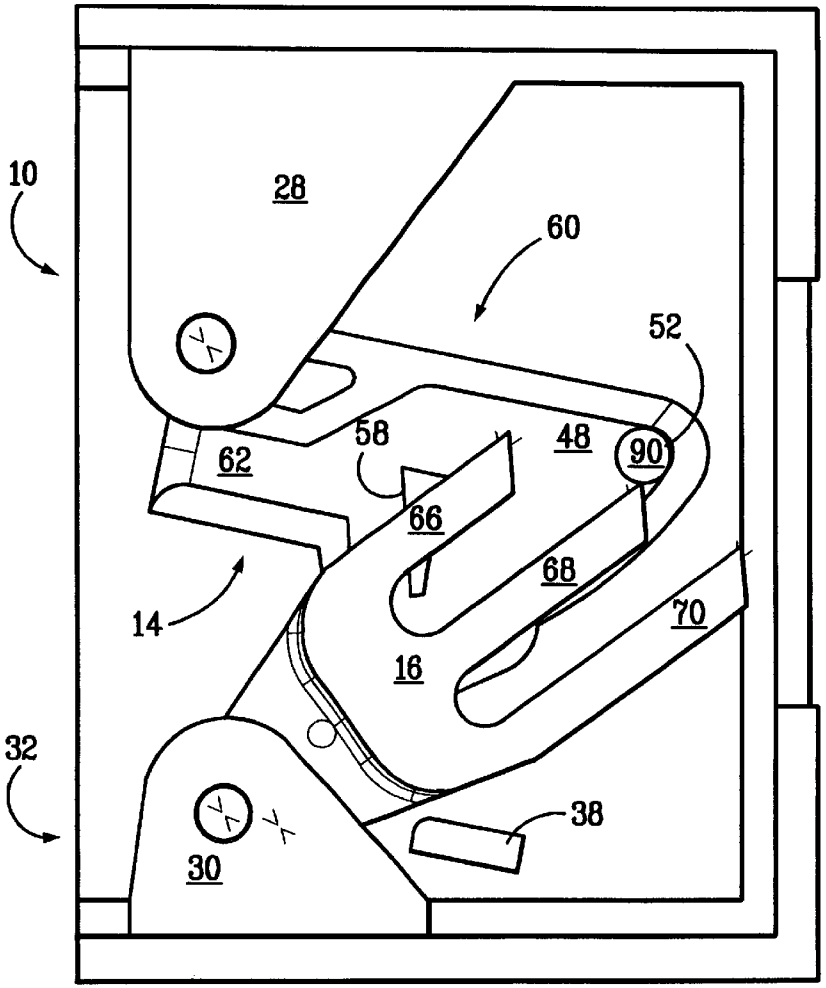
FIG 27 is a top view of a latch according to the present invention, showing the position of the components as the pin enters the third socket.
Figure 30:
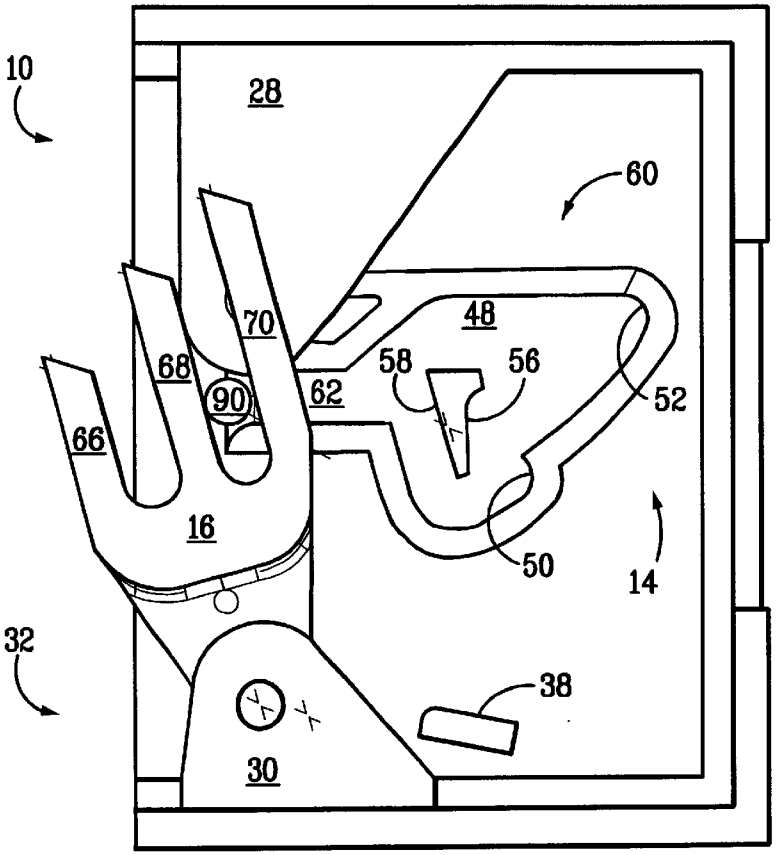
FIG. 30 is a top view of a latch according to the present invention, showing the position of the components as the pin exits the shuttle.
Figure 29:
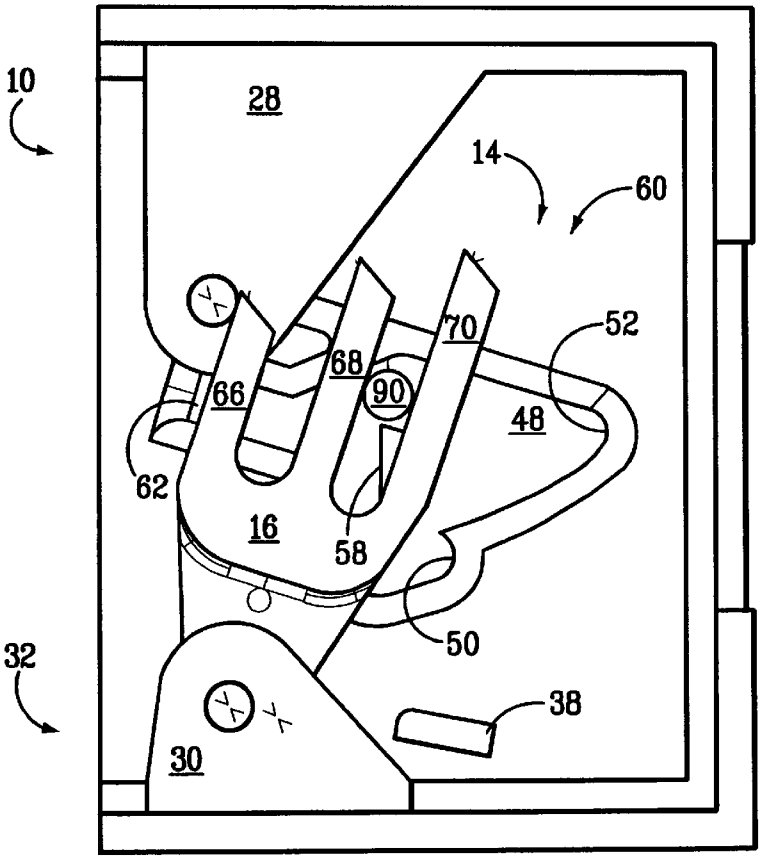
FIG. 29 is a top view of a latch according to the present invention, showing the position of the components as the pin moves past the ramp towards the exit of the shuttle's channel.
Figure 31:
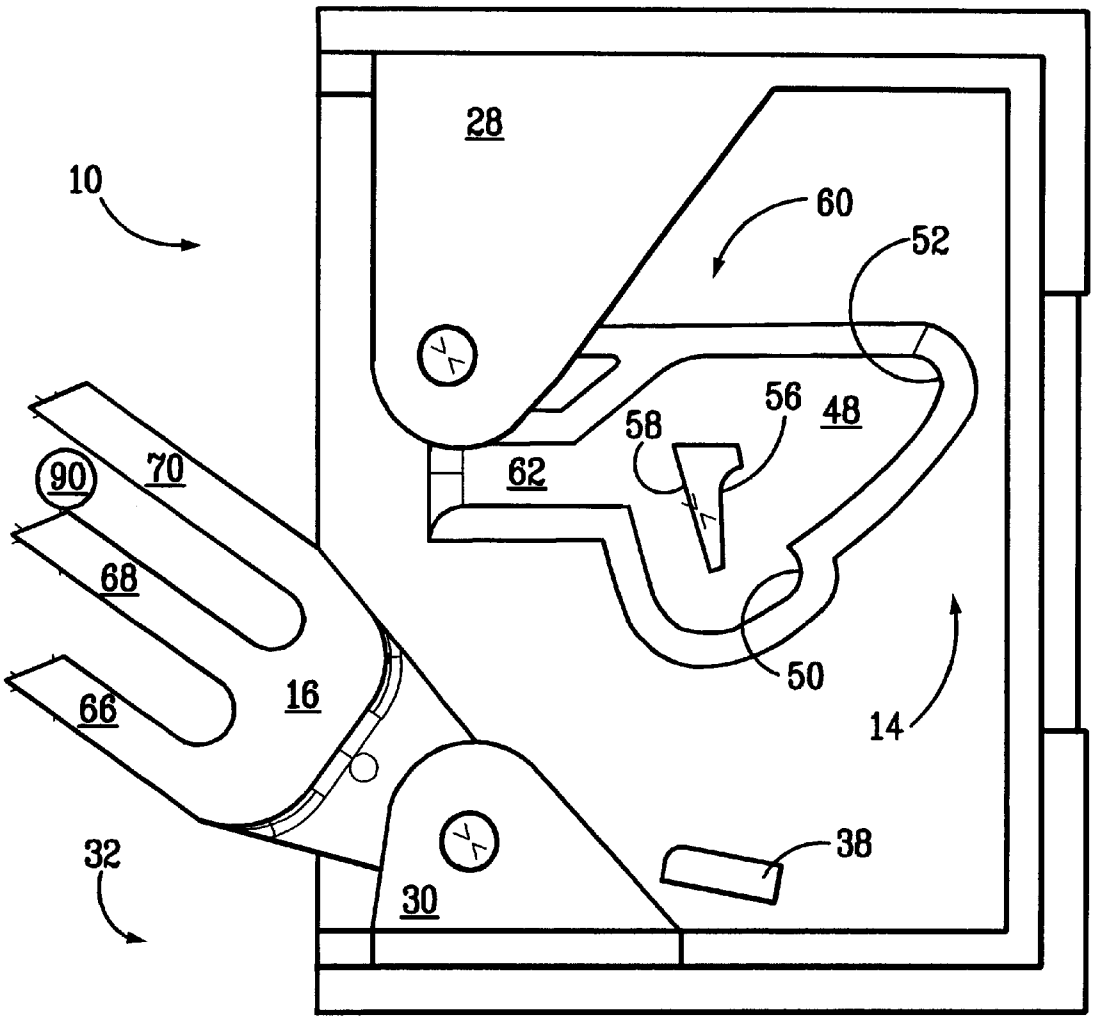
FIG. 31 is a top view of a latch according to the present invention, showing the position of the components as the pin exits the fork, after leaving the shuttle.

Unlatching the latch is accomplished by the user pushing inward on the moving member. As illustrated in FIG. 27, this inward push moves the pin 90 linearly rearward from the second socket 56 to the third socket 52. As the pin 90 reaches the third socket 52, it will push rearwardly on the shuttle 14, thereby rotating the shuttle 14 counterclockwise. The pin 90 will simultaneously rotate the fork 16 clockwise, reaching the end of prong 68 as it reaches the third socket 52. Because the pin 90 is no longer pushing rearward on prong 68, the spring 18 will rotate the fork 16 counterclockwise towards its original position, until the prong 70 strikes the pin, making an audible click, as illustrated in FIG. 28. Upon hearing the click and feeling the resistance to pushing, the user will stop pushing the moving member inward, freeing the spring-biased moving member to move outward. At this point, the shuttle 14 is rotated such that, when the pin 90 moves linearly forward, the heart curve 60 will direct the pin 90 out of the shuttle through the entrance channel 62, as illustrated in FIGS. 29–31. The linear movement of the pin 90 through the channel 62 will rotate the shuttle 14 back to its original orientation. Likewise, the spring-biased fork 16 will return to its original orientation. The latch 10 is thereby returned to the configuration illustrated in FIG. 21 and prepared to repeat the latching an unlatching cycle.

It is to be understood that the invention is not limited to the preferred embodiments described herein, but encompasses all embodiments within the scope of the following claims.

I claim:

1. A push-push latch for mating with a pin, said push-push latch comprising:

a housing defining an open front and an open top; and a shuttle having a front portion and a rear portion, said front portion corresponding to said front opening of said housing, said front portion having an off center pivot mating with said housing, and an entrance channel, said rear portion having a second channel having dimensions that are greater than dimensions of said entrance channel, said second channel defining a first forward-facing socket and containing an island, said island defining a forward facing ramp and a rearward facing second socket, said second channel further defining a forward facing third socket, said ramp being dimensioned and configured to deflect said pin towards said first socket.

2. The push-push latch according to claim 1, wherein said second channel, ramp, first socket, second socket, and third socket define a heart-curve.

3. A push-push latch for mating with a pin, said push-push latch comprising:

a housing defining an open front and an open top; and a shuttle having a front portion and a rear portion, said front portion corresponding to said front opening of said housing, said front portion having an off center pivot mating with said housing, and an entrance channel, said off center pivot comprises a pair of opposing pegs mating with a pair of opposing holes, said rear portion having a second channel having dimensions that are greater than dimensions of said entrance channel, said second channel defining a first forward-facing socket and containing an island, said island defining a forward facing ramp and a rearward facing second socket, said second channel further defining a forward facing third socket, said ramp being dimensioned and configured to deflect said pin towards said first socket.

4. The push-push latch according to claim 3, wherein said second channel, ramp, first socket, second socket, and third socket define a heart-curve.

5. A push-push latch for mating with a pin, said push-push latch comprising:

a housing comprises a bottom, a pair of sides, a back, an open top, an open front, and at least one flange extending over said open top; and a shuttle having a front portion and a rear portion, said front portion corresponding to said front opening of said housing, said front portion having an off center pivot mating with said housing, and an entrance channel, said rear portion having a second channel having dimensions that is greater than dimensions of said entrance channel, said second channel defining a first forward-facing socket and containing an island, said island defining a forward facing ramp and a rearward facing second socket, said second channel further defining a forward facing third socket, said ramp being dimensioned and configured to deflect said pin towards said first socket.

6. The push-push latch according to claim 5, wherein said at least one flange and said bottom define at least one pair of opposing holes.

7. The push-push latch according to claim 5, wherein said shuttle's pivot is a pair of cylindrical pegs being dimensioned and configured to fit within said opposing holes.

8. The push-push latch according to claim 5, wherein said second channel, ramp, first socket, second socket, and third socket define a heart-curve.

9. The push-push latch according to claim 5, wherein said off center pivot comprises a pair of opposing pegs mating with a pair of opposing holes.

10. The push-push latch according to claim 5, further comprising a fork having a plurality of prongs arranged in order of increasing length, a rear juncture joining said prongs, and a pivot for mating with said housing, said fork being spring-biased towards an orientation wherein said prongs are substantially parallel to said front of said housing.

11. The push-push latch according to claim 10, further comprising biasing means biasing said fork towards an orientation wherein said prongs are substantially parallel to said front of said housing.

12. The push-push latch according to claim 11, wherein said biasing means is a spring.

13. The push-push latch according to claim 12, wherein said housing further has a spring-retaining flange and a pair of sides, said spring is a wire coiled spring having a central coil, a long end projecting outward perpendicular to the axis of said coil, and a short end projecting outward parallel to the axis of said coil, said long end is dimensioned and configured to fit between said spring-retaining flange and a corresponding side of said sides of said housing, said short end is dimensioned and configured to fit within a hole of said fork.

14. The push-push latch according to claim 5, further comprising a stem defining said pivot for mating with said housing.

15. The push-push latch according to claim 14, wherein said pivot includes a pair of opposing pegs on each end of said stem.

16. The push-push latch according to claim 15, wherein said housing further defines a pair of opposing holes dimensioned and configured to receive said opposing pegs on said stem.

17. A push-push latch for mating with a pin, said push-push latch comprising:

a housing defining an open front and an open top;

a shuttle having a front portion and a rear portion, said front portion corresponding to said front opening of said housing, said front portion having an off center pivot mating with said housing, and an entrance channel, said rear portion having a second channel having dimensions that are greater than dimensions of said entrance channel, said second channel defining a first forward-facing socket and containing an island, said island defining a forward facing ramp and a rearward facing second socket, said second channel further defining a forward facing third socket, said ramp being dimensioned and configured to deflect said pin towards said first socket; and a fork having a plurality of prongs arranged in order of increasing length, a rear juncture joining said prongs, and a pivot for mating with said housing, said fork being spring-biased towards an orientation wherein said prongs are substantially parallel to said front of said housing.

18. The push-push latch according to claim 17, wherein said plurality of prongs are three in number.

19. The push-push latch according to claim 17, wherein said pivot is a pair of opposing pegs mating with a pair of opposing holes.

20. The push-push latch according to claim 17, further comprising a stem defining said pivot for mating with said housing.

21. The push-push latch according to claim 20, wherein said pivot includes a pair of opposing pegs on each end of said stem.

22. The push-push latch according to claim 21, where said housing further defines a pair of opposing holes dimensioned and configured to received said opposing pegs on said stem.

23. The push-push latch according to claim 17, further comprising biasing means biasing said fork towards an orientation wherein said prongs are substantially parallel to said front of said housing.

24. The push-push latch according to claim 23, wherein said biasing means is a spring.

25. The push-push latch according to claim 24, wherein said housing further has a spring-retaining flange and a pair of sides, said spring is a wire coiled spring having a central coil, a long end projecting outward perpendicular to the axis of said coil, and a short end projecting outward parallel to the axis of said coil, said long end is dimensioned and configured to fit between said spring-retaining flange and a corresponding side of said sides of said housing, said short end is dimensioned and configured to fit within a hole of said fork.

26. The push-push latch according to claim 17, wherein said second channel, ramp, first socket, second socket, and third socket define a heart-curve.

* * * * *